US007958650B2

(12) United States Patent
Turatti

(10) Patent No.: US 7,958,650 B2
(45) Date of Patent: Jun. 14, 2011

(54) APPARATUS FOR DRYING FOODSTUFFS

(75) Inventor: Antonio Turatti, Cavarzere (IT)

(73) Assignee: Turatti S.R.L., Cavarzere (IT)

( * ) Notice: Subject to any disclaimer, the term of this patent is extended or adjusted under 35 U.S.C. 154(b) by 0 days.

(21) Appl. No.: 11/695,740

(22) Filed: Apr. 3, 2007

(65) Prior Publication Data

US 2008/0005918 A1 Jan. 10, 2008

(30) Foreign Application Priority Data

Jan. 23, 2006 (IT) ..... RM2006A0027
Apr. 12, 2006 (IT) ..... RM2006A0211

(51) Int. Cl.
*F26B 7/00* (2006.01)

(52) U.S. Cl. ..... 34/58; 34/421; 34/572; 34/90; 34/595; 219/400; 210/360.1; 15/3.2; 68/12.01; 68/26

(58) Field of Classification Search ..... 34/58, 421, 34/572, 90, 595; 219/400; 210/360.1; 15/3.2; 68/12.01, 26
See application file for complete search history.

(56) References Cited

U.S. PATENT DOCUMENTS 1,537,625 A * 5/1925 Skinner ..... 34/58
1,601,423 A * 9/1926 Alexander ..... 34/58
1,675,076 A * 6/1928 Wurfflein ..... 34/58
1,775,048 A * 9/1930 Papworth ..... 210/360.1
1,956,589 A * 5/1934 Perry ..... 8/137
1,997,621 A * 4/1935 Adsit et al. ..... 210/360.1
2,124,381 A * 7/1938 Wayland ..... 34/58
2,166,379 A * 7/1939 Skagerberg ..... 34/546
2,234,766 A * 3/1941 Kennedy ..... 15/3.2
2,275,854 A * 3/1942 Jones ..... 34/58
2,368,811 A * 2/1945 Einarsson ..... 34/58
2,552,322 A * 5/1951 Jennings ..... 69/47
2,559,713 A * 7/1951 Dunski et al. ..... 34/421
2,577,104 A * 12/1951 Butler ..... 34/572
2,655,023 A * 10/1953 Bilde et al. ..... 68/26
2,743,533 A * 5/1956 Smith ..... 34/547
2,941,308 A * 6/1960 Cobb et al. ..... 34/552
2,987,305 A * 6/1961 Calhoun, Jr. ..... 432/31
2,990,624 A * 7/1961 Granath et al. ..... 34/102
3,161,481 A * 12/1964 Edwards ..... 34/527
3,186,104 A * 6/1965 Stilwell, Jr. ..... 34/527
3,217,422 A * 11/1965 Fuqua et al. ..... 34/527
3,228,113 A * 1/1966 Fannon, Jr. ..... 34/308
3,234,449 A * 2/1966 Lang et al. ..... 318/461
3,237,314 A * 3/1966 Smith, Jr. ..... 34/266
3,252,228 A * 5/1966 Ehrenfreund ..... 34/584
3,270,530 A * 9/1966 Czech ..... 68/18 R (Continued)

FOREIGN PATENT DOCUMENTS

DE 3100540 A1 * 7/1982

(Continued)

*Primary Examiner* — Stephen M. Gravini
(74) *Attorney, Agent, or Firm* — Gauthier & Connors LLP

(57) ABSTRACT

The invention relates to an improved apparatus (1) for drying food-stuffs, comprising at least a centrifugation basket (5) for drying said product by its rotation, the lateral surface of said basket (5) being holed; a pin (13) rotating coupled with said at least a centrifugation basket (5); and a motor (12), mechanically coupled with said rotation pin (13); said apparatus (1) being characterised in that said motor (12) is a synchronous three-phase electric motor (12) and in that it comprises means (16) for controlling rotation of said motor (12) for adjusting the torque output by said motor (12) with respect to its rotation speed.

12 Claims, 2 Drawing Sheets

U.S. PATENT DOCUMENTS

| | | | | | |
|---|---|---|---|---|---|
| 3,273,256 | A | * | 9/1966 | Behrens | 34/546 |
| 3,279,093 | A | * | 10/1966 | Dutton | 34/229 |
| 3,293,771 | A | * | 12/1966 | Lawrence et al. | 34/592 |
| 3,310,881 | A | * | 3/1967 | Fritzberg | 34/313 |
| 3,339,732 | A | * | 9/1967 | Bergman | 34/319 |
| 3,343,272 | A | * | 9/1967 | Janke et al. | 34/528 |
| 3,359,644 | A | * | 12/1967 | Goldman | 34/58 |
| 3,369,305 | A | * | 2/1968 | Becker | 34/451 |
| 3,391,469 | A | * | 7/1968 | Reeder | 34/58 |
| 3,406,954 | A | * | 10/1968 | Fannon, Jr. | 432/41 |
| 3,456,357 | A | * | 7/1969 | Griffith | 34/401 |
| 3,507,052 | A | * | 4/1970 | Robandt | 34/380 |
| 3,621,900 | A | * | 11/1971 | Rood | 99/636 |
| 3,765,612 | A | * | 10/1973 | Wenger | 241/23 |
| 3,802,089 | A | * | 4/1974 | Stephanoff | 34/327 |
| 3,805,956 | A | * | 4/1974 | Mercier | 210/96.1 |
| 3,811,300 | A | * | 5/1974 | Barton et al. | 68/12.19 |
| 3,811,834 | A | * | 5/1974 | Schwemmer et al. | 8/116.1 |
| 3,878,620 | A | * | 4/1975 | Gallahue et al. | 34/454 |
| 3,885,321 | A | * | 5/1975 | Fouineteau | 34/58 |
| 3,945,921 | A | * | 3/1976 | Toth | 34/322 |
| 3,964,175 | A | * | 6/1976 | Sivetz | 34/589 |
| 4,090,310 | A | * | 5/1978 | Koff | 34/58 |
| 4,103,432 | A | * | 8/1978 | Dieterich et al. | 34/58 |
| 4,115,927 | A | * | 9/1978 | Rosensweig | 34/249 |
| 4,136,016 | A | * | 1/1979 | Rosensweig | 208/134 |
| 4,189,850 | A | * | 2/1980 | Dieterich et al. | 34/58 |
| 4,206,008 | A | * | 6/1980 | Tacke et al. | 156/115 |
| 4,209,916 | A | * | 7/1980 | Doyel | 34/58 |
| 4,211,015 | A | * | 7/1980 | Adams et al. | 34/293 |
| 4,237,154 | A | * | 12/1980 | Garrison | 427/241 |
| 4,296,080 | A | * | 10/1981 | Rosensweig | 423/244.06 |
| 4,321,031 | A | * | 3/1982 | Woodgate | 432/11 |
| 4,321,756 | A | * | 3/1982 | Mosely | 34/322 |
| 4,323,478 | A | * | 4/1982 | Adams et al. | 426/641 |
| RE31,439 | E | * | 11/1983 | Rosensweig | 34/249 |
| 4,432,148 | A | * | 2/1984 | Darbonne et al. | 34/58 |
| 4,464,809 | A | * | 8/1984 | Trisolini | 15/260 |
| 4,467,530 | A | * | 8/1984 | Fesmire et al. | 34/313 |
| 4,481,786 | A | * | 11/1984 | Bashark | 62/160 |
| 4,493,156 | A | * | 1/1985 | Siegmann | 34/319 |
| 4,531,307 | A | * | 7/1985 | Kuecker | 34/552 |
| 4,614,660 | A | * | 9/1986 | Weibye | 426/461 |
| 4,621,438 | A | * | 11/1986 | Lanciaux | 34/77 |
| 4,702,162 | A | * | 10/1987 | Sontheimer et al. | 99/495 |
| 4,714,812 | A | * | 12/1987 | Haagensen et al. | 219/697 |
| 5,027,530 | A | * | 7/1991 | Vollmer et al. | 34/58 |
| 5,044,092 | A | * | 9/1991 | Journet et al. | 34/312 |
| 5,054,209 | A | * | 10/1991 | Koff | 34/58 |
| 5,068,979 | A | * | 12/1991 | Wireman et al. | 34/58 |
| 5,101,575 | A | * | 4/1992 | Bashark | 34/562 |
| 5,107,606 | A | * | 4/1992 | Tsubaki et al. | 34/596 |
| 5,159,764 | A | * | 11/1992 | Wireman et al. | 34/359 |
| 5,184,544 | A | * | 2/1993 | Ling | 99/536 |
| 5,212,876 | A | * | 5/1993 | Berit | 34/58 |
| 5,212,969 | A | * | 5/1993 | Tsubaki et al. | 68/19.2 |
| 5,282,319 | A | * | 2/1994 | Casquilho et al. | 34/318 |
| 5,291,668 | A | * | 3/1994 | Becker et al. | 34/86 |
| 5,303,999 | A | * | 4/1994 | Nath et al. | 366/25 |
| 5,307,567 | A | * | 5/1994 | Schnake et al. | 34/319 |
| 5,317,964 | A | * | 6/1994 | Prudhomme | 99/495 |
| 5,322,367 | A | * | 6/1994 | Nath et al. | 366/7 |
| 5,339,539 | A | * | 8/1994 | Shiraishi et al. | 34/58 |
| 5,344,229 | A | * | 9/1994 | Nath et al. | 366/25 |
| 5,377,708 | A | * | 1/1995 | Bergman et al. | 134/105 |
| 5,435,075 | A | * | 7/1995 | Shiraishi et al. | 34/58 |
| 5,466,408 | A | * | 11/1995 | Assier | 264/156 |
| 5,469,634 | A | * | 11/1995 | Mezaki | 34/58 |
| 5,477,623 | A | * | 12/1995 | Tomizawa et al. | 34/58 |
| 5,485,683 | A | * | 1/1996 | Morgan | 34/58 |
| 5,540,152 | A | * | 7/1996 | DeMoore | 101/483 |
| 5,540,391 | A | * | 7/1996 | Anderson | 241/17 |
| 5,544,421 | A | * | 8/1996 | Thompson et al. | 34/58 |
| 5,553,391 | A | * | 9/1996 | Bakalar | 34/110 |
| 5,564,831 | A | * | 10/1996 | Bashark | 374/141 |
| 5,582,532 | A | * | 12/1996 | Tucker | 446/475 |
| 5,647,140 | A | * | 7/1997 | Hudspeth | 34/58 |
| 5,651,193 | A | * | 7/1997 | Rhodes et al. | 34/531 |
| 5,664,337 | A | * | 9/1997 | Davis et al. | 34/58 |
| 5,673,496 | A | * | 10/1997 | Wegner et al. | 34/471 |
| 5,675,905 | A | * | 10/1997 | Hougham | 34/58 |
| 5,678,320 | A | * | 10/1997 | Thompson et al. | 34/58 |
| 5,692,313 | A | * | 12/1997 | Ikeda et al. | 34/58 |
| 5,715,610 | A | * | 2/1998 | Smith et al. | 34/58 |
| 5,715,743 | A | * | 2/1998 | Goddard | 99/403 |
| 5,778,769 | A | * | 7/1998 | Dodson | 99/536 |
| 5,780,295 | A | * | 7/1998 | Livesey et al. | 435/307.1 |
| 5,784,802 | A | * | 7/1998 | Thompson et al. | 34/312 |
| 5,802,733 | A | * | 9/1998 | Hougham | 34/58 |
| 5,852,882 | A | * | 12/1998 | Kendall et al. | 34/599 |
| 5,887,456 | A | * | 3/1999 | Tanigawa et al. | 68/20 |
| 5,891,347 | A | * | 4/1999 | Matsumoto | 210/770 |
| 5,904,090 | A | * | 5/1999 | Lillelund et al. | 99/495 |
| 5,906,056 | A | * | 5/1999 | Noguchi et al. | 34/596 |
| 5,941,165 | A | * | 8/1999 | Butte | 99/355 |
| 5,960,561 | A | * | 10/1999 | Parodi et al. | 34/550 |
| 5,964,043 | A | * | 10/1999 | Oughton et al. | 34/92 |
| 5,966,830 | A | * | 10/1999 | Schnacke | 34/58 |
| 5,966,835 | A | * | 10/1999 | Bakalar | 34/267 |
| 5,992,042 | A | * | 11/1999 | Mitchell et al. | 34/319 |
| 5,992,309 | A | * | 11/1999 | Mulhauser et al. | 99/495 |
| 5,996,241 | A | * | 12/1999 | Thompson et al. | 34/58 |
| 6,014,817 | A | * | 1/2000 | Thompson et al. | 34/60 |
| 6,018,883 | A | * | 2/2000 | Mulhauser | 34/58 |
| 6,041,515 | A | * | 3/2000 | Ally et al. | 34/230 |
| 6,052,917 | A | * | 4/2000 | Matsumoto | 34/138 |
| 6,112,429 | A | * | 9/2000 | Mitchell et al. | 34/312 |
| 6,122,843 | A | * | 9/2000 | Noguchi et al. | 34/596 |
| 6,125,550 | A | * | 10/2000 | Kendall et al. | 34/316 |
| 6,143,221 | A | * | 11/2000 | Gurol | 264/118 |
| 6,151,799 | A | * | 11/2000 | Jones | 34/378 |
| 6,170,170 | B1 | * | 1/2001 | Van Felius | 34/313 |
| 6,202,452 | B1 | * | 3/2001 | Ura et al. | 68/23.7 |
| 6,247,339 | B1 | * | 6/2001 | Kenjo et al. | 68/12.04 |
| 6,260,391 | B1 | * | 7/2001 | Rippe | 68/210 |
| 6,298,575 | B1 | * | 10/2001 | Aikins et al. | 34/58 |
| 6,327,793 | B1 | * | 12/2001 | Gurer et al. | 34/317 |
| 6,343,546 | B2 | * | 2/2002 | Ancona et al. | 99/495 |
| 6,393,972 | B1 | * | 5/2002 | Backus et al. | 99/421 R |
| 6,412,191 | B1 | * | 7/2002 | Moyls | 34/328 |
| 6,418,834 | B1 | * | 7/2002 | Perrine | 99/334 |
| D462,881 | S | * | 9/2002 | Mulhauser et al. | D7/665 |
| 6,473,988 | B1 | * | 11/2002 | Mulhauser et al. | 34/58 |
| 6,510,785 | B1 | * | 1/2003 | Margolin | 99/495 |
| 6,560,893 | B1 | * | 5/2003 | Bakalar | 34/110 |
| 6,589,359 | B2 | * | 7/2003 | Kamikawa et al. | 134/26 |
| 6,622,618 | B1 | * | 9/2003 | Glucksman et al. | 99/495 |
| 6,651,357 | B2 | * | 11/2003 | Bria et al. | 34/427 |
| 6,662,466 | B2 | * | 12/2003 | Gurer et al. | 34/317 |
| 6,681,497 | B2 | * | 1/2004 | Bria et al. | 34/79 |
| D486,040 | S | * | 2/2004 | Lo et al. | D7/665 |
| 6,722,672 | B2 | * | 4/2004 | Cates et al. | 280/47.26 |
| 6,745,489 | B1 | * | 6/2004 | Kuhl | 34/58 |
| 6,751,886 | B2 | * | 6/2004 | Chang et al. | 34/96 |
| 6,789,330 | B2 | * | 9/2004 | Ally et al. | 34/380 |
| 6,821,459 | B1 | * | 11/2004 | Usami | 264/1.33 |
| 6,827,092 | B1 | * | 12/2004 | Smith et al. | 134/149 |
| 6,904,703 | B2 | * | 6/2005 | Naganawa et al. | 34/596 |
| 6,920,704 | B1 | * | 7/2005 | Silverbrook et al. | 34/422 |
| 6,944,970 | B2 | * | 9/2005 | Silverbrook et al. | 34/621 |
| 6,960,372 | B2 | * | 11/2005 | Motomura | 427/358 |
| 6,993,854 | B2 | * | 2/2006 | Ise et al. | 34/58 |
| 7,000,436 | B2 | * | 2/2006 | Peterson | 68/12.04 |
| 7,028,415 | B2 | * | 4/2006 | Heinzen et al. | 34/312 |
| 7,337,712 | B1 | * | 3/2008 | Wang et al. | 99/511 |
| 7,448,315 | B2 | * | 11/2008 | Mulhauser et al. | 99/495 |
| 7,818,894 | B2 | * | 10/2010 | Noyes et al. | 34/169 |
| 2001/0006991 | A1 | * | 7/2001 | Vidaurre et al. | 524/494 |
| 2001/0020611 | A1 | * | 9/2001 | Ally et al. | 219/400 |
| 2002/0092198 | A1 | * | 7/2002 | Bria et al. | 34/444 |
| 2002/0112370 | A1 | * | 8/2002 | Gurer et al. | 34/476 |
| 2003/0024280 | A1 | * | 2/2003 | Peterson | 68/12.01 |
| 2003/0051366 | A1 | * | 3/2003 | Ise et al. | 34/58 |
| 2003/0150126 | A1 | * | 8/2003 | Chang et al. | 34/96 |
| 2003/0233765 | A1 | * | 12/2003 | Heinzen et al. | 34/321 |
| 2004/0010937 | A1 | * | 1/2004 | Naganawa et al. | 34/595 |
| 2004/0093755 | A1 | * | 5/2004 | Kuhl | 34/58 |

| | | | | |
|---|---|---|---|---|
| 2004/0103552 | A1* | 6/2004 | Rhon | 34/58 |
| 2004/0211081 | A1* | 10/2004 | Heinzen et al. | 34/58 |
| 2005/0076531 | A1* | 4/2005 | Smith et al. | 34/313 |
| 2005/0144801 | A1* | 7/2005 | Wilson | 34/60 |
| 2005/0155248 | A1* | 7/2005 | Silverbrook et al. | 34/422 |
| 2005/0155252 | A1* | 7/2005 | Silverbrook et al. | 34/621 |
| 2006/0260366 | A1* | 11/2006 | Slutsky et al. | 68/3 R |
| 2006/0288605 | A1* | 12/2006 | Carow et al. | 34/446 |
| 2006/0288608 | A1* | 12/2006 | Carow et al. | 34/604 |
| 2007/0068036 | A1* | 3/2007 | Choi | 34/528 |
| 2007/0113421 | A1* | 5/2007 | Uhara et al. | 34/275 |
| 2007/0180727 | A1* | 8/2007 | Wan et al. | 34/58 |
| 2007/0245591 | A1* | 10/2007 | Gens et al. | 34/443 |
| 2008/0004963 | A1* | 1/2008 | Montalbano et al. | 705/14 |
| 2008/0005918 | A1* | 1/2008 | Turatti | 34/58 |
| 2008/0016714 | A1* | 1/2008 | Kaneyama et al. | 34/317 |
| 2008/0034611 | A1* | 2/2008 | Carow et al. | 34/565 |
| 2008/0210103 | A1* | 9/2008 | Wan et al. | 99/495 |
| 2008/0229609 | A1* | 9/2008 | Bronshtein | 34/287 |
| 2008/0295353 | A1* | 12/2008 | Ogawa | 34/312 |
| 2009/0094853 | A1* | 4/2009 | Noyes et al. | 34/233 |
| 2009/0114104 | A1* | 5/2009 | Sawhney et al. | 99/495 |
| 2009/0249837 | A1* | 10/2009 | Uhara et al. | 68/19 |
| 2009/0266383 | A1* | 10/2009 | Wang | 134/25.3 |
| 2009/0272004 | A1* | 11/2009 | Chernetski et al. | 34/389 |
| 2009/0305612 | A1* | 12/2009 | Miyazaki et al. | 451/11 |
| 2010/0000114 | A1* | 1/2010 | Dalton et al. | 34/389 |
| 2010/0031526 | A1* | 2/2010 | Tuckett | 34/60 |
| 2010/0043839 | A1* | 2/2010 | Hamada et al. | 134/30 |
| 2010/0115785 | A1* | 5/2010 | Ben-Shmuel et al. | 34/260 |
| 2010/0205821 | A1* | 8/2010 | Tada et al. | 34/428 |
| 2010/0205826 | A1* | 8/2010 | Ashrafzadeh et al. | 34/499 |

FOREIGN PATENT DOCUMENTS

| | | | |
|---|---|---|---|
| DE | 4232647 | A1 * | 5/1993 |
| EP | 796942 | A2 * | 9/1997 |
| EP | 908239 | A1 * | 4/1999 |
| EP | 1331460 | A2 * | 7/2003 |
| EP | 1449444 | * | 8/2004 |
| EP | 1512333 | A2 * | 3/2005 |
| EP | 1844660 | A1 * | 10/2007 |
| GB | 2174564 | A * | 11/1986 |
| JP | 58190031 | A * | 11/1983 |
| JP | 62117602 | A * | 5/1987 |
| JP | 01160593 | A * | 6/1989 |
| JP | 02160074 | A * | 6/1990 |
| JP | 03278530 | A * | 12/1991 |
| JP | 04084998 | A * | 3/1992 |
| JP | 04220298 | A * | 8/1992 |
| JP | 04256784 | A * | 9/1992 |
| JP | 04338497 | A * | 11/1992 |
| JP | 04347199 | A * | 12/1992 |
| JP | 05277280 | A * | 10/1993 |
| JP | 05277290 | A * | 10/1993 |
| JP | 06154468 | A * | 6/1994 |
| JP | 06154490 | A * | 6/1994 |
| JP | 06213564 | A * | 8/1994 |
| JP | 06225985 | A * | 8/1994 |
| JP | 06246088 | A * | 9/1994 |
| JP | 07148380 | A * | 6/1995 |
| JP | 07263399 | A * | 10/1995 |
| JP | 07313434 | A * | 12/1995 |
| JP | 08098988 | A * | 4/1996 |
| JP | 08098991 | A * | 4/1996 |
| JP | 08114314 | A * | 5/1996 |
| JP | 08155341 | A * | 6/1996 |
| JP | 08261648 | A * | 10/1996 |
| JP | 08336693 | A * | 12/1996 |
| JP | 09050980 | A * | 2/1997 |
| JP | 09290089 | A * | 11/1997 |
| JP | 09290090 | A * | 11/1997 |
| JP | 10137488 | A * | 5/1998 |
| JP | 11104390 | A * | 4/1999 |
| JP | 11128584 | A * | 5/1999 |
| JP | 11128585 | A * | 5/1999 |
| JP | 11128595 | A * | 5/1999 |
| JP | 11188195 | A * | 7/1999 |
| JP | 11188196 | A * | 7/1999 |
| JP | 11188197 | A * | 7/1999 |
| JP | 11244570 | A * | 9/1999 |
| JP | 11244574 | A * | 9/1999 |
| JP | 2000014960 | A * | 1/2000 |
| JP | 2000014961 | A * | 1/2000 |
| JP | 2000014962 | A * | 1/2000 |
| JP | 2000042284 | A * | 2/2000 |
| JP | 2000197792 | A * | 7/2000 |
| JP | 2000197793 | A * | 7/2000 |
| JP | 2000287906 | A * | 10/2000 |
| JP | 2000350884 | A * | 12/2000 |
| JP | 2000350886 | A * | 12/2000 |
| JP | 2000350887 | A * | 12/2000 |
| JP | 2000350888 | A * | 12/2000 |
| JP | 2000350889 | A * | 12/2000 |
| JP | 2000350894 | A * | 12/2000 |
| JP | 2000350895 | A * | 12/2000 |
| JP | 2001046777 | A * | 2/2001 |
| JP | 2001046794 | A * | 2/2001 |
| JP | 2001087588 | A * | 4/2001 |
| JP | 2001174156 | A * | 6/2001 |
| JP | 2001190893 | A * | 7/2001 |
| JP | 2001190894 | A * | 7/2001 |
| JP | 2002018187 | A * | 1/2002 |
| JP | 2002195751 | A * | 7/2002 |
| JP | 2005245565 | A * | 9/2005 |
| JP | 2007147251 | A * | 6/2007 |
| JP | 2010088488 | A * | 4/2010 |

* cited by examiner

APPARATUS FOR DRYING FOODSTUFFS

PRIORITY INFORMATION

This application claims priority to Italian Patent application No. RM2006A000211 filed on Apr. 12, 2006, which is incorporated by reference in its entirety herein.

BACKGROUND OF THE INVENTION

1. Field of the Invention

The present invention relates to an improved apparatus for drying foodstuffs.

More specifically, the invention relates to an apparatus of the above kind, particularly studied and realised for removing humidity from leaf products, permitting optimised power consumption for every situation.

2. Brief Description of the Art

As it is well known, many apparatuses or machines exist for drying leaf products, such as vegetables or fruit, or for removing water from the same. Particularly, different kind of said apparatuses or machines exist exploiting centrifugal force for removing said residual humidity.

Above mentioned machines are usually comprised of a rotating basket, with vertical or horizontal axis, containing the product to be dried. Said basket is driven by an electric, hydraulic or pneumatic motor. Drying cycle is a batch cycle, providing a basket loading step, a centrifugation step and a product discharge step.

Rotation speed and working time can be usually adjusted. Some of these machines are loaded and unloaded on the same side and thus mechanisms for upturning the same are provided. Other machines are loaded and unloaded from opposite ends.

Known machines providing electric motors usually use asynchronous three-phase motors. Said motors overheat at low speed due to their design criteria, i.e. during the loading and unloading steps, and, moreover, they have a peak of power absorption at the start, thus when beginning the centrifugation, with a very low torque generated.

In view of the above, known electric centrifugal apparatuses must provide oversized motors, with cooling device for operation at low speed. This increases their dimensions, thus making the same not convenient.

Furthermore, asynchronous three-phase motors must provided transmission pulleys for reduction of number of revolution, as well as electronic speed regulators (inverter), the adjustment range of which is in any case very limited (ratio between about 1 and about 3).

As far as centrifugal machines or apparatuses driven by hydraulic motors, it is known that they can have an even torque with low regime, but that they are huge, being activated by suitable stations. Therefore, they are more Complex to be realised and assembled but, particularly, in case of oil leakages, they can contaminate the product.

SUMMARY OF THE INVENTION

In view of the above it is object of the present invention that of providing an apparatus for removing surface humidity of different products by centrifugal force, having high capacity, reduced dimensions and driven by an electric motor.

Another object of the invention is that of providing an apparatus outputting a uniform torque with low regime.

It is therefore specific object of the present invention an improved apparatus for drying foodstuffs, comprising at least a centrifugation basket for drying said product by its rotation, the lateral surface of which is holed; a pin rotating coupled with said at least a centrifugation basket; and a motor, mechanically coupled with said rotation pin; said apparatus being characterised in that said motor is a asynchronous three-phase electric motor and in that it comprises means for controlling rotation of said motor for adjusting the torque output by said motor with respect to its rotation speed.

Always according to the invention, said control means can comprise an encoder for detection of the rotation speed or of the position of said motor.

Still according to the invention, said control means can comprise a feedback control device connected with said encoder for adjusting supply and/or power output to said motor on the basis of the value of the motor speed detected by said encoder.

Preferably, according to the invention, said apparatus can comprise a support housing, within which said at least a centrifugation basket is placed, rotating coupled with the same housing, said housing collecting liquid due to drying said product exiting through the holes on the lateral surface of said rotating centrifugation basket, said housing and said centrifugation basket realising a centrifugation assembly; at least an axis fixed to said housing; motion means mechanically coupled with said at least an axis, said motion means permitting rotation of said centrifugation basket with respect to its axis, in order to bring the same in the loading and unloading positions.

Furthermore, according to the invention, said motor can be placed between said housing and said centrifugation basket by a joint, said joint being fixed to said housing and rotating coupled with said rotation pin.

Always according to the invention, said motion means can comprise a motor, preferably an electric motor.

Preferably, according to the invention, said at least one axis can be a substantially horizontal axis.

Still according to the invention, said housing can comprise at least a discharge for outflow of said liquid arriving from the product drying.

Preferably, according to the invention, said improved apparatus can comprise means for discharging the dried product, such as a conveyor belt.

Still according to the invention, said improved apparatus can comprise a structure for supporting said centrifugation assembly.

BRIEF DESCRIPTION OF THE DRAWINGS

The present invention will be now described, for illustrative but not limitative purposes, according to its preferred embodiments, with particular reference to the figures of the enclosed drawings, wherein.

DETAILED DESCRIPTION OF THE INVENTION

Figure 2:
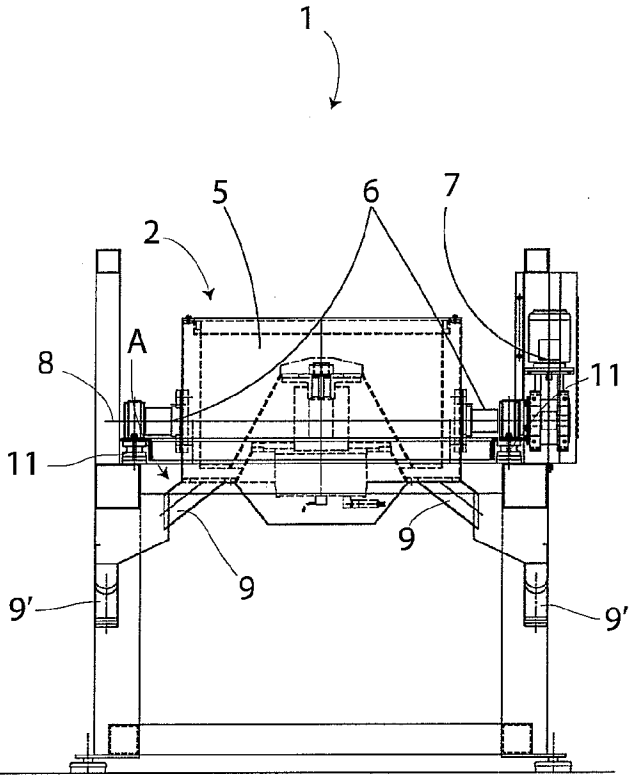
FIG. 2 shows a section front view of apparatus according to FIG. 1.
Figure 1:
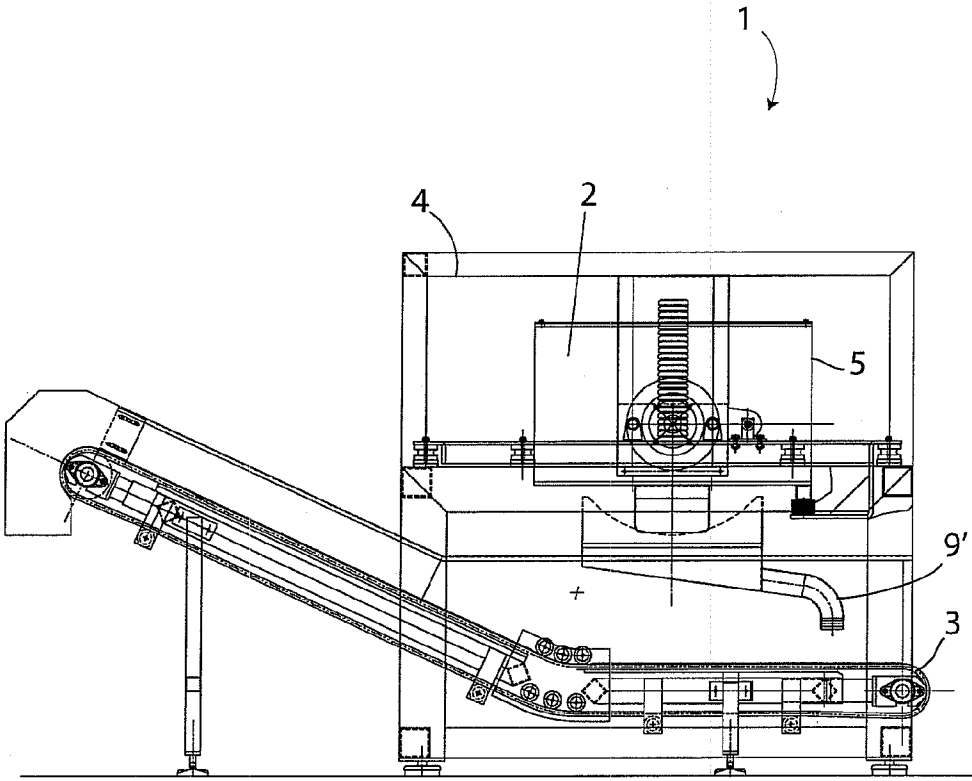
FIG. 1 shows a lateral view of drying apparatus for foodstuffs, particularly leaf products according to the present invention.

Making reference to FIGS. 1 and 2 of the enclosed drawings, it is possible observing apparatus 1 for drying leaf products according to the invention.

Said apparatus 1 comprises a drying assembly 2, under which a product removal conveyor belt 3 is provided.

Said drying assembly is mounted on a support structure 4. It comprises a rotating centrifugation basket 5, mounted on substantially horizontal pins 6. Said pins 6 permit rotation of said centrifugation basket 5 according to direction A.

Said pins 6 permits to the centrifugation basket rotation about axis 8 during the unloading of the dried product by a motor 7.

Centrifugation basket 5 is holed on its surface (holes cannot be seen in the figures).

Discharge outlets 9 are provided under said centrifugation basket 5, connected with discharge cups, for outlet of water extracted from products during centrifugation.

Figure 3:
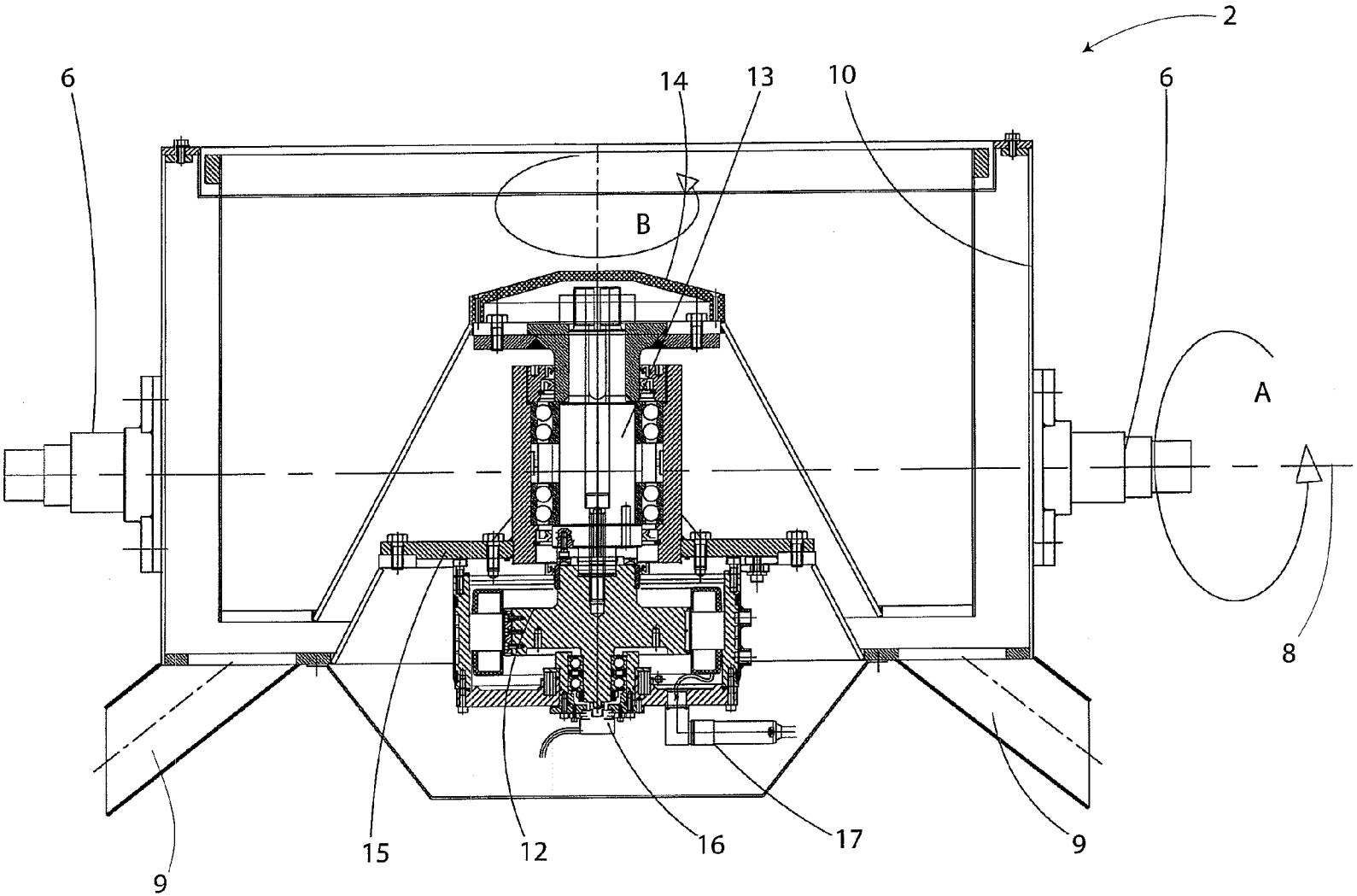
FIG. 3 shows a lateral section view of the drying group of apparatus according to FIG. 1.

Making now reference to FIG. 3, it can be noted that centrifugation basket 5 is placed within a hosing housing 10, coupled with said pins 6, resting on supports 11.

Within inner volume of said centrifugation basket 5, between the same basket and said housing 10, it is provided a synchronous centrifugation electric motor 12, for rotating the centrifugation basket according to direction B with respect to its symmetry axis.

Centrifugation basket 5 is connected with a rotation pin 13 by the upper part of a rotating joint 14. Outer part 15 of said rotating joint 14 is fixed on housing 10 along with motor 12. The whole drying assembly 2 can rotate about said horizontal axis 8 and about said pins 6.

Motor 12 is provided with an encoder 16 for controlling the position of the same motor 12, a power supply cable 17 and elements 18 for water cooling.

During the loading and centrifugation steps, said centrifugation basket 5 has its opening upward. When the centrifugation step is terminated, centrifugation basket upturns, rotating about axis 8 by said motor 7 acting on said pins 6, discharging the centrifuged product on the product removal conveyor belt 3.

Said centrifuged product is sent to the following workings by said product removal conveyor belt 3.

During the centrifugation step of the product contained within the centrifugation basket 5, carried out by said motor 12, water extracted from the product passes through the holes of the same centrifugation basket 5, collects within the housing 10 and outflows by outlets 9 and cups 9'.

Motor 12 is of the asynchronous three-phase type. It usually is used for high precision tools and in all those cases requiring a high torque at low regime along with a high precision of movements.

Encoder 17, permitting proper operation of said motor 12, is an electronic device. It permits detecting speed of rotating members, in this case synchronous three-phase motor 12, reading its position.

Said encoder 16 can be of many kinds. Opto-electronic encoders are widely used, permitting, by excitation of photodiodes, detecting speed of a rotating member.

Encoder 16 is connected to a retroaction control circuit (not shown in the figures), connected to supply of said motor 12. particularly, once detected speed by said encoder 16, control circuit adjust power output to said motor 12, thus optimising torque output by the same. Particularly, it is possible obtaining keeping a constant torque of said motor 12 within a wide speed range (in the described embodiment between about 0 and 1000 rpm).

This kind of motors has a further positive feature. In the water cooled type, it has reduced dimensions, so as to be directly placed on the rotating pin 13 of the centrifugation basket.

These positive features, combined with a good design, permit realising a device with high capacity, high precision, reliability and reduced dimensions.

On the basis of the above specification, it can be noted that basic feature of the present invention is that of using a synchronous three-phase motor in a drying apparatus, employing a retroaction control device permitting maintaining a constant torque in a very wide speed range.

An advantage of the present invention is due to the reduced dimensions of the apparatus.

The present invention has been described for illustrative but not limitative purposes, according to its preferred embodiments, but it is to be understood that modifications and/or changes can be introduced by those skilled in the art without departing from the relevant scope as defined in the enclosed claims.

What is claimed is:

1. An improved apparatus for drying foodstuffs, comprising:

at least a centrifugation basket for drying said product by its rotation, the lateral surface of said basket being holed;

a pin rotating coupled with said at least a centrifugation basket; and a motor, mechanically coupled with said rotation pin; wherein said motor is a synchronous three-phase electric motor and it comprises means for controlling rotation of said motor for adjusting the torque output by said motor with respect to its rotation speed; wherein said control means comprise an encoder for detection of the rotation speed or of the position of said motor; and wherein said control means comprise a feedback control device connected with said encoder for adjusting supply and/or power output to said motor on the basis of the value of the motor speed detected by said encoder.

2. The improved apparatus according to claim 1, wherein said encoder is an opto-electronic encoder.

3. The improved apparatus according to claim 1, wherein said apparatus comprises a support housing, within which said at least a centrifugation basket is placed, rotating coupled with the same housing, said housing collecting liquid extracted during drying step of said product exiting through the holes on the lateral surface of said rotating centrifugation basket, said housing and said centrifugation basket realising a centrifugation assembly; at least a pin fixed to said housing; motion means mechanically coupled with said at least a pin, said motion means permitting rotation of said centrifugation basket with respect to said pin, in order to bring the same in the loading and unloading positions.

4. The improved apparatus according to claim 3, wherein said motor is placed between said housing and said centrifugation basket by a joint, said joint being fixed to said housing and rotating coupled with said rotation pin.

5. The improved apparatus according to claim 3, wherein said motion means comprises a second motor.

6. The improved apparatus according to claim 3, wherein said at least one pin is a substantially horizontal pin.

7. The improved apparatus according to claim 3, wherein said housing comprises at least a discharge for outflow of said liquid arriving from the product drying step.

8. The improved apparatus according to claim 3, wherein it comprises means for discharging the dried product.

9. The improved apparatus according to claim 8, wherein said means for discharging the dried product are comprised of a conveyor belt.

10. The improved apparatus according to claim 3, wherein it comprises a structure for supporting said centrifugation assembly.

11. The improved apparatus according to claim 5, wherein said second motor is electric.

12. The improved apparatus according to claim 1, wherein said centrifugation basket can rotate about both a vertical and a horizontal axis such that said centrifugation basket rotates about a vertical axis when drying said product and rotates about a horizontal axis when discharging said product from said apparatus.

* * * * *